United States Patent [19]

Juilfs et al.

[11] 4,048,695

[45] Sept. 20, 1977

[54] DOOR CHECK AND CLOSURE DEVICE

[76] Inventors: Otto H. Juilfs; Donald R. Juilfs, both of 19701 Lassen St., Chatsworth, Calif. 91311

[21] Appl. No.: 633,819

[22] Filed: Nov. 20, 1975

[51] Int. Cl.[2] ..... E05F 3/00

[52] U.S. Cl. ..... 16/65; 16/DIG. 10; 16/80; 16/82; 16/85

[58] Field of Search ..... 16/63, 64, 65, 82, DIG. 10

[56] References Cited

U.S. PATENT DOCUMENTS 3,555,591 1/1971 Sogoian ..... 16/82 X

FOREIGN PATENT DOCUMENTS 1,177 5/1906 United Kingdom .....16/65

*Primary Examiner*—Werner H. Schroeder
*Assistant Examiner*—Conrad L. Berman
*Attorney, Agent, or Firm*—Sanford Astor

[57] ABSTRACT

This invention relates to a door closer and holder having a longitudinally movable rod containing a niche which rests against a stop plate to hold the door in an open position. A rotating cam is positioned adjacent the niche in the rod so that further movement of the rod in a longitudinal matter rotates the cam causing the rod to ride over and bypass the stop plate allowing the door to close.

3 Claims, 13 Drawing Figures

DOOR CHECK AND CLOSURE DEVICE

BACKGROUND OF THE INVENTION

There are many door closer mechanisms presently existing of the type wherein a cylindrical casing houses a piston which is laterally movable within a bore. In door closers of this type, a spring within the casing biases the piston towards one end of the cylinder and attempts to keep the door in a closed position. The piston and cylinder are connected respectively to a door and door frame so that when the door is opened, the piston is pushed in a direction to compress the spring. When the door is released, the spring causes the piston and rod to move the door back to a closed postion. Many door closers of this type are presently in existence in which no means is provided to keep the door in an open position without the person opening the door holding it with their hand or foot.

There are many instances in which the user of the door may wish to hold the door temporarily in an open position such as when he is carrying packages. While door closing mechanisms presently exist which do have means to hold the door in an open postion, applicants' invention is designed to be added to an existing door closure which does not have such a means attached so that the door closure does not have to be completely replaced, with one that has the door hold-open feature.

It is an object of the present invention to provide a new and improved door closer and door holder which conveniently and easily both closes the door and provides means to hold the door in an open position, if desired.

It is a further object of this invention to provide a mechanism which can be added to an existing door closing mechanism which does not have a door hold-open feature so that the door can be held open if desired.

Yet another object of the invention is to provide a convenient and cheap method for modifying existing door closures so that they are given a hold-open ability.

Yet another object of the invention is to provide a simple self-contained door closure and holder which both closes the door automatically and provides a means to hold the door open if desired by the user.

Other objects and advantages of the present invention will become apparent by reference to the following description taken in connection with the accompanying drawings in which.

Figure 1:
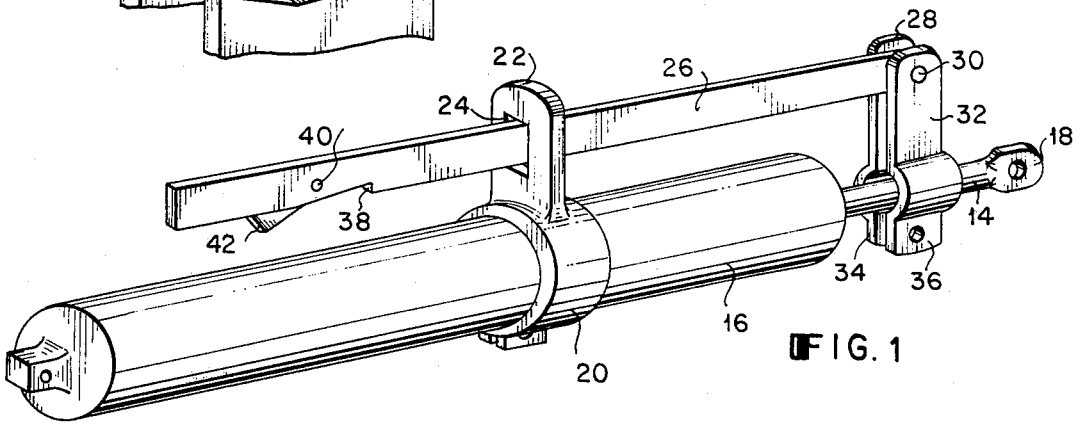
FIG. 1 is a perspective view of the device in accordance with the present invention.

Referring now to FIG. 1, there is shown a standard cylindrical casing type door closure mechanism 10 having a mounting bracket 12 which is adapted to be pivotably mounted to a door frame (not shown).

The piston rod 14 is mounted longitudinally within the cylindrical casing 16 and contains bracket 18 for mounting to the door (not shown). The cylindrical door closer device described above is a standard door closer device presently available. The device of applicants' invention will now be described attached onto the existing door closing device to provide a stop means in order to hold the door in an open position.

A mounting bracket 20 is attached circumferentially around the cylindrical shell 16 of the door closer device.

The bracket 20 has an elevated portion 22 containing a rectangular slot 24 through which passes a rectangular or square rod 26. The piston rod end 28 of square rod 26 is fixedly attached by a mounting pin 30 to a bracket 32 which is attached at the other end of the bracket to piston rod 18. The bracket attaches rod 18 circumferential bracket mounting 34 which can be tightened with a screw 36 to hold the bracket securely to the piston rod 18. Square rod 26 contains a niche 38 on the opposite side of the bracket 22 from the bracket 32. Pivotably mounted on pin 40 within a slot (not seen) in square rod 26 is a rotating cam 43 which may rotate on pin 40.

When the door is swung open, the door causes piston rod 18 to withdraw longitudinally from the cylindrical shell 16 which presses against a spring, not shown in this figure, within the cylindrical shell 16 which is attempting to bias the door into a closed position. When the door opens sufficiently to cause the rod 26 to pass through the slot 24 and bracket 22 to the point where niche 38 passes just through the slot 24, and if the person opening the door then releases pressure on the door, the spring within cylindrical column 16 will attempt to close the door and the niche 38 will catch against the inside of slot 24 holding the door in an open position.

Figure 2:
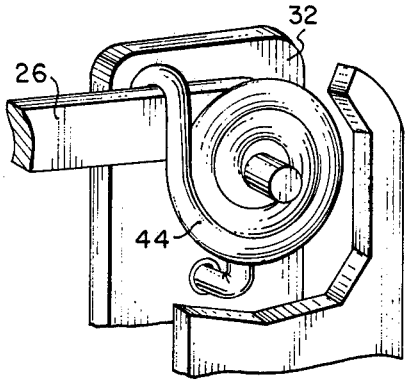
FIG. 2 is a perspective view of the rod linkage portion of the present invention.

Referring now to FIG. 2, there is shown the mounting bracket 32 with the front portion cut away exposing a coil spring 44 which extends over the top of rod 26 biasing rod 26 in a downward position. The purpose of this spring is to hold rod 26 in a biased downward position so that notch 38 is pushed downward after it passes through slot 24 so that the inside surface of notch 38 catches against the lower horizontial edge of slot 24 after the notch passes through the slot 24 when the door is opened.

Figure 3:
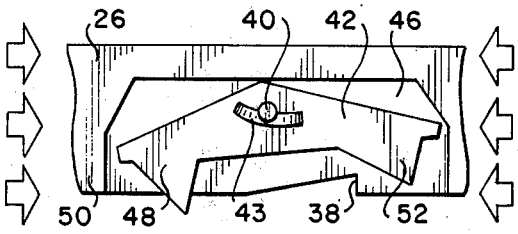
FIG. 3 is an exploded cutaway view of the rotating cam of the present invention with the door in a closed position.

Referring now to FIG. 3, there is shown the rotating cam 42 which may be also called a flip-flop which rotates on pin 40 and is contained in a narrow slot 46 within rod 26. In FIG. 3, the rotating cam is shown in the position it takes when the door is in a closed position. The rotating cam is in this position because at the time the door was last closed, and rod 26 passed back through slot 24, the rotating cam 42 was rotated in a counter-clockwise direction exposing the left-end of the cam 48, below the lower horizontial edge 50 of rod 26. The right edge 52 of the rotating cam 42 is pushed up into the slot 46 by the friction against the lower horizontial surface of slot 24 as rod 26 passed through it. A leaf-spring 43 presses against the cam 42 and the inside edge of the rod 26 to provide resistance to movement of the cam 42.

Figure 4:
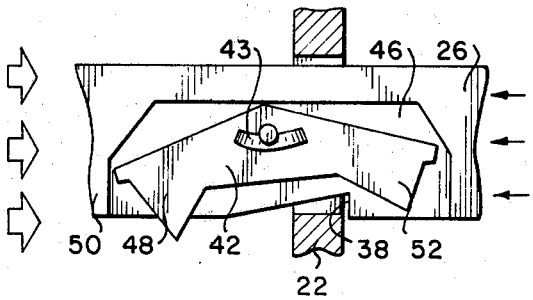
FIG. 4 is a exploded cutaway view of the rotating cam with the door in a hold-open position.

Referring now to FIG. 4, there is shown the rotating cam 42 in the position it takes when the door is opened and the niche 38 is resting against the lower horizontial edge of the slot 24 in bracket 22. In this case, the door has been opened to a point where the niche 38 has passed just through the slot 24 in bracket 22, and the right edge of 52 of cam 42 is up inside the slot 46 in rod 26 while the left edge 48 of rotating cam 42 is exposed below the horizontial edge 50 of rod 26.

Figure 5:
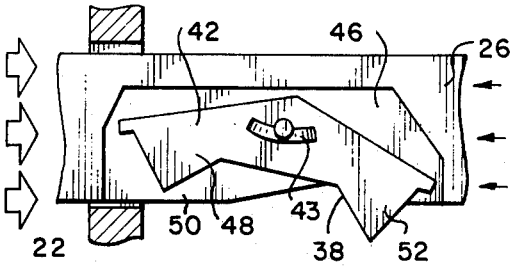
FIG. 5 is an exploded cutaway view of the rotating cam in an extended release position.

Referring now to FIG. 5, there is shown the extended release position of rotating cam 42 which is accomplished by the person using the door pushing the door further open. By pushing the door further open, the rotating cam 42 is passed completely through slot 24 in bracket 22 and the lower edge of slot 24 by friction against the lower edge 50 of rod 56 rotates the cam in a clock-wise position, lifting the left edge 48 of cam 42 up into the slot 46 in rod 26 and rotating the right edge 52 of cam 42 outside and below the lower horizontial edge 50 of rod 26.

Figure 6:
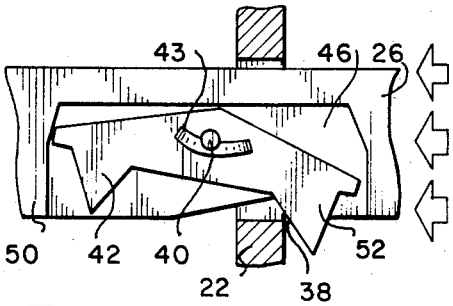
FIG. 6 is an exploded cutaway view of the rotating cam in the return position.

FIG. 6 shows how the device of the present invention allows the door to then close freely to a fully closed position after the person using the door releases it. In this figure it can be seen that rotating cam 42 is in the rotated clockwise position, that is shown in FIG. 5, and as the rod 26 is moved to the left by the action of piston rod 18 moved by the spring within the cylindrical tube 16, the rod 26 reaches the point where it would otherwise have been stopped by the niche 38 in the rod, however, at this point the rotating cam 42 has rotated to a clockwise position where the edge 52 provides a rider over which the lower edge 50 of rod 26 passes so that the bracket 22 rides over the rotated edge 52 of cam 42 and by-passes the niche in the rod so that the rod 26 can continue riding the slot 24 of bracket 22 until the door is in a fully closed position.

Figure 7:
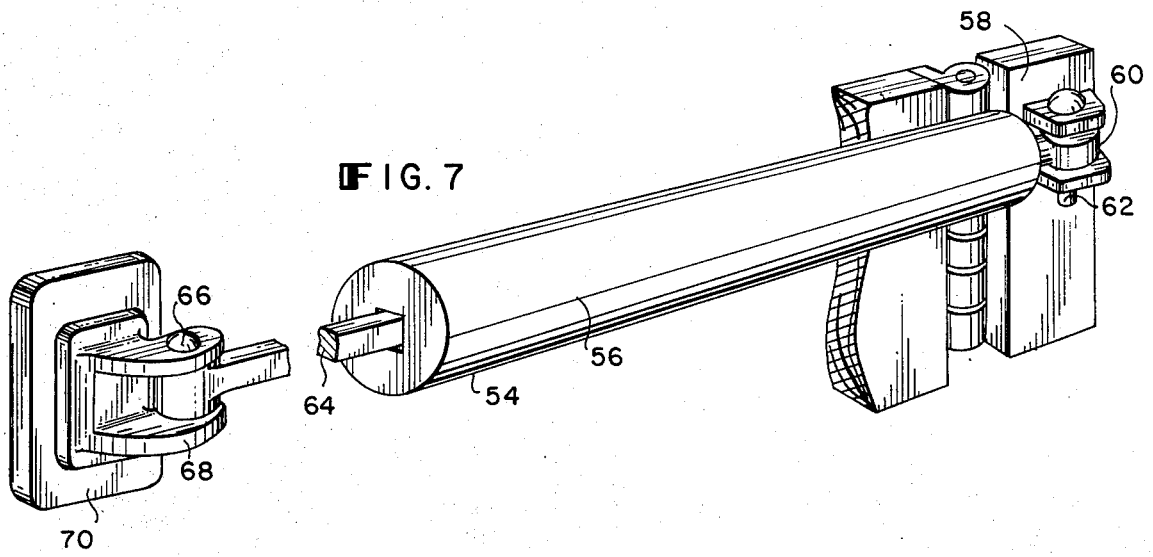
FIG. 7 is a perspective view of another aspect of applicants' invention.

Referring now to FIG. 7, there is shown the self-contained embodiment of applicants' invention in which the rotating cam feature is contained totally within the door closer mechanism. There is shown a cylindrical door closer mechanism 54 having a cylindrical casing 56. The casing 56 is fixedly attached to the door frame 58 by a bracket 60 which is pivotably mounted on a pin 62 and a bracket 64 attached to the door frame 58. At the other end of the door closer mechanism, a piston rod 64 is rotatably attached through a pin 66 to a mounting bracket 68 which is attached to the door 70. The door, of course, is mounted through door hinges 72 onto the inside of the door frame.

Figure 8:
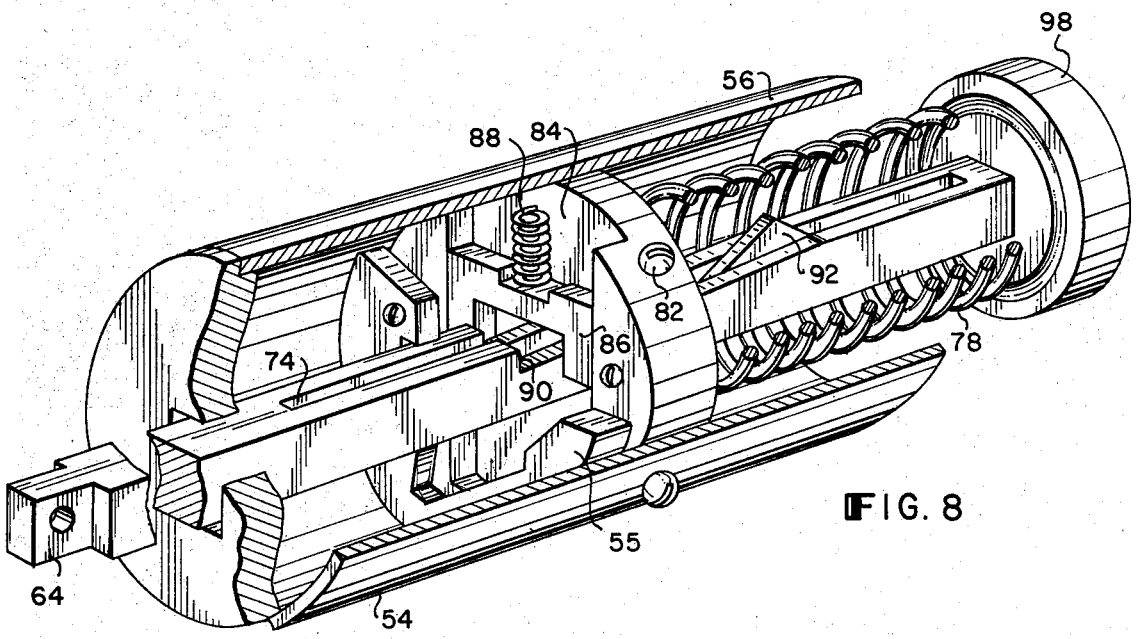
FIG. 8 is a perspective view partially cut away from the device of the present invention.

Referring now to FIG. 8, there is shown a cutaway view of the door closer mechanism of this embodiment in which there is shown the door closer mechanism 54 with cylindrical casing 56. The piston rod 64 is rectangular or square in shape and contains a vertical slot 74 throughout a portion of its top surface 76. A spring 78 is contained within the cylindrical shell 56 and presses against a fixed circular plate 80. The circular plate 80 is fixed into position within the cylindrical shell 56 by a plurality of screws 82 holding plate 80 in a fixed position. Plate 80 has a vertical cut out space 84, within which is placed a key 86 adapted to slide in a vertical manner within space 84. A spring 88 biases the key 86 in a downward direction towards the top surface 76 of rod 64. A coverplate, not shown, is fixedly attached to plate 80 to hold key 86 and spring 88 in position.

A niche 90 is contained in the surface or rod 64 and a cam 92 is centered in the slot 74 of rod 64. Cam 92 is rotated on a pin, not shown, similar to that described in FIG. 1.

Figure 9:
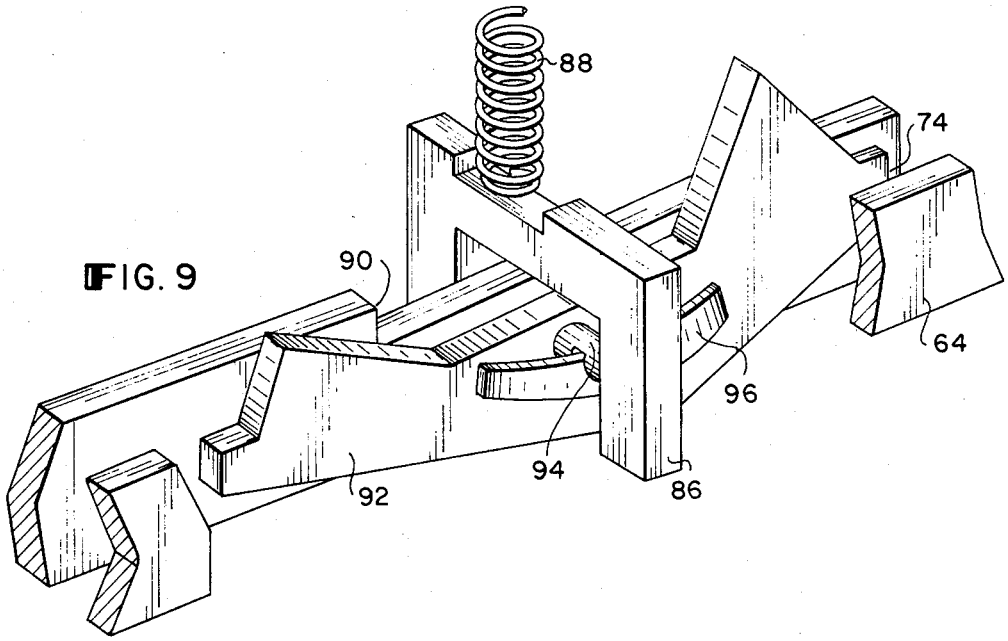
FIG. 9 is a fragmentary view of the door stop mechanism of the present invention as shown in FIG. 7.
Figure 10:
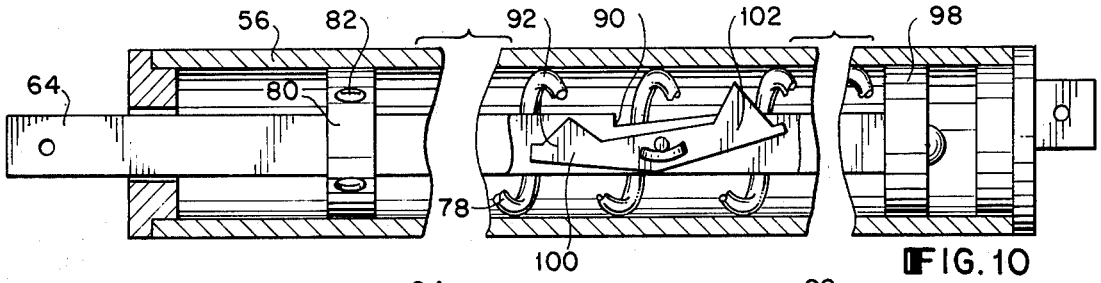
FIG. 10 is a cutaway view showing the rotating cam in a door closed position.

Referring now to FIG. 9, there is shown a cutaway description of the arrangement of the cam 92 within the slot 74 of the piston rod 64. As can be seen, the cam 92 rotates on pin 94 and a leaf spring 96 is placed between pin 94 and the inside edge of slot 74 in rod 64 which provides resistance to rotation of cam 92. The spring 88 is shown, which biases key 86 in a downward direction. The niche 90, when it passes through and under key 86, spring 88 will cause key 86 to bias in a downward direction so that the niche 90 will catch against the upper surface of key 86 stopping rod 64 from movement.

This is more clearly shown in FIG. 10 through 13, in which the cylindrical shell 56 contains the spring 78 in a closed door position. The piston rod 64 is shown with the fixed plate 80 fixed into the cylindrical shell 56 by screws 82 and the other end of spring 78 is fixed against a piston plate 98 which is slidably movable within shell 56. With the door in a closed position, cam 92 is rotated in a clockwise direction so that the right leg 100 is rotated in a clockwise direction below the level of the slot 74 and the left leg 102 is also rotated in a clockwise direction.

Figure 11:
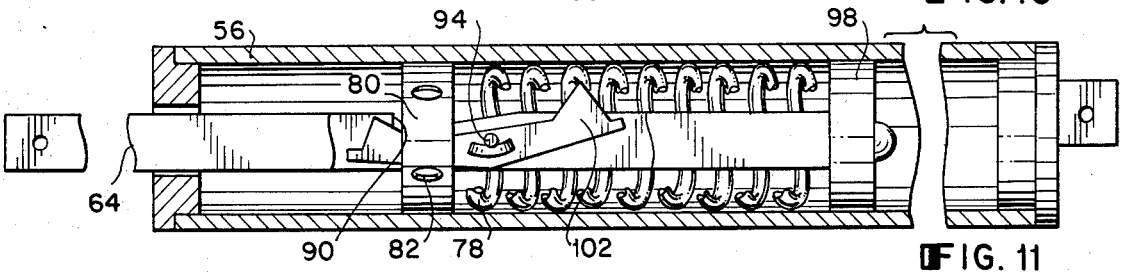
FIG. 11 is a cutaway view showing the rotating cam in a hold open position.

FIG. 11 shows the position of the cam 92 in the door position where the door is being held by the niche 90 being pressed against the key 86 within the fixed plate 80. The spring 78 is now partially compressed and attempting to urge the door into a closed position however, the niche 90, resting against the key 86 within the plate 80, stops the door from returning to the closed position. The left leg 102 of cam 92 remains in a clockwise rotated position.

Figure 12:
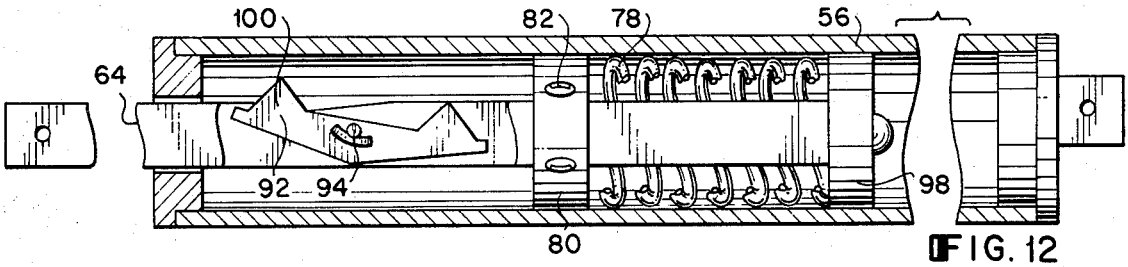
FIG. 12 is a cutaway view showing the rotating cam in a release position.

Referring now to FIG. 12, there is shown the extended release position of the cam 92 which occurs when the person using the door swings the door into a further open position. Here the entire cam 92 has passed by the key 86. The key has forced down the left leg 102 below the top surface of the slot 74 in the rod 64 and the right leg 100 of key 92 has been raised above the level of the slot 74.

Figure 13:
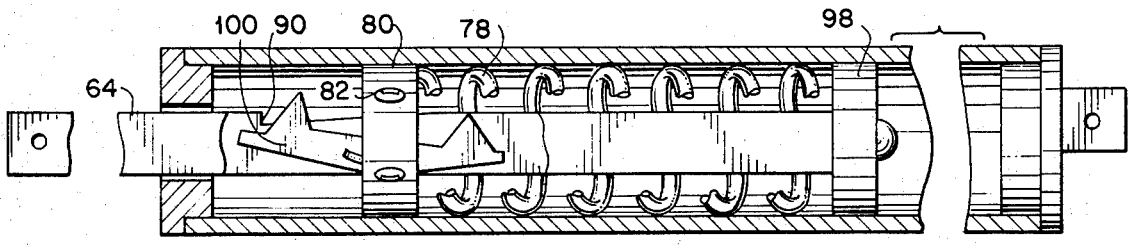
FIG. 13 is a cutaway view showing the rotating cam in a return position.

Referring now to FIG. 13, there is shown the manner in which this further opening of the door allows the door to go into a fully closed position. As the spring 78 forces the piston 98 to return the door to a closed position, the niche 90 is stopped from catching on the horizontal surface of the key 86 by leg 100 of cam 92 which provides a slanted surface, which rides the key 86 up and over niche 90, allowing the rod to pass completely through fixed plate 80 and under key 86 and not allowing niche 90 to catch on key 86, so that the door returns to a completely closed position.

The advantage in the invention of applicants' device is that a person often will come through a door in a situation such as where he has packages in his hands and he has no free hand to hold the door open. Using the device of the present invention, with his foot or with his body, he may push the door to a point where the door is held open by the niche in the push rod catching in the slot or against the key within the door hold-open mechanism. He may then enter the door return and get more packages if he desires or do whatever is necessary while having the door open. He may then with his foot or with his body, push the door further open which activates the cam so that the door may then swing shut into a fully closed position. The device of the present invention as stated may be easily affixed to an existing door close mechanism which has no hold-open feature or it may be built into a self-contained unit, and added to an existing door. The principle however, in both the added unit or the self-contained unit is exactly the same, that of a rotating cam which either allows or prevents a niche in the push rod catching against a stopping mechanism within the unit itself.

The door close mechanism may be made of any material suitable for such a purpose as various metals, steel, aluminum etc. or even a plastic if desired.

Having thus described the invention it is requested that the scope of the invention be limited only by the appended claims as follows:

We claim:

1. A door closure device comprising a cylindrical shell, a spring disposed within said shell, a piston rod adapted to interact with said spring for resisting the opening of a door and for causing closing of a door, a slot disposed longitudinally in said rod, a plate fixedly mounted in said shell against which one end of the spring rests, a slot cut into said plate, a key within said slot which is adapted to engage a niche in said rod to hold a door in an open position, a rotatable cam rotatably mounted within the slot in the rod adapted to allow the key to override the niche in said rod to allow a door to close.

2. The device of claim 1 wherein a spring biases said key in the direction of said rod.

3. The device of claim 1 comprising a leaf spring to resist rotation of said cam.

* * * * *